US006164865A

United States Patent [19]

McCallum

[11] Patent Number: 6,164,865

[45] Date of Patent: Dec. 26, 2000

[54] INTERLOCKING BARRIER SYSTEM WITH MULTIPLE SECURING MECHANISMS

[76] Inventor: Gerald L. McCallum, 9134-D SW. 20th Pl., Fort Lauderdale, Fla. 33324

[21] Appl. No.: 09/303,731

[22] Filed: May 3, 1999

Related U.S. Application Data

[63] Continuation-in-part of application No. 09/152,575, Sep. 14, 1998, abandoned.

[51] Int. Cl.[7] ..... E01F 13/00; E01F 9/00

[52] U.S. Cl. ..... 404/6; 404/9

[58] Field of Search ..... 404/6, 9, 10; 256/13.1

[56] References Cited

U.S. PATENT DOCUMENTS

| | | | |
|---|---|---|---|
| D. 385,362 | 10/1997 | Rossetti | D25/38 |
| 3,209,662 | 10/1965 | Morton | 94/13 |
| 3,540,699 | 11/1970 | Guzzardelia | 256/13.1 |
| 4,040,759 | 8/1977 | Skalle | 404/6 |
| 4,224,002 | 9/1980 | Heenan et al. | 404/9 |
| 4,773,629 | 9/1988 | Yodock | 256/13.1 |
| 4,778,250 | 10/1988 | McRoskey et al. | 404/6 |
| 4,869,617 | 9/1989 | Chiodo | 404/6 |
| 4,946,306 | 8/1990 | Yodock | 404/6 |
| 4,954,009 | 9/1990 | Kellison | 404/6 |
| 4,964,750 | 10/1990 | House et al. | 404/6 |
| 5,104,255 | 4/1992 | Bodensohn | 404/7 |
| 5,123,773 | 6/1992 | Yodock | 404/6 |
| 5,137,391 | 8/1992 | Ballesteros | 404/6 |
| 5,425,594 | 6/1995 | Krage et al. | 404/6 |
| 5,429,448 | 7/1995 | Ballesteros | 404/6 |
| 5,452,963 | 9/1995 | Christensen | 404/6 |
| 5,498,101 | 3/1996 | Braverman | 404/6 |
| 5,531,540 | 7/1996 | Wasserstrom et al. | 404/6 |
| 5,605,413 | 2/1997 | Brown | 404/6 |
| 5,611,641 | 3/1997 | Christensen | 404/6 |
| 5,685,665 | 11/1997 | Lembo | 404/6 |
| 5,857,802 | 1/1999 | Richter | 404/14 |

FOREIGN PATENT DOCUMENTS

| | | | |
|---|---|---|---|
| 3012681 | 8/1981 | Germany | 404/6 |

*Primary Examiner*—Eileen D. Lillis
*Assistant Examiner*—Raymond W Addie
*Attorney, Agent, or Firm*—John C. Smith

[57] ABSTRACT

A lightweight barrier with locking devices at the top, middle, and bottom. Each barrier has an I-shaped male tab and a matching female slot. The I-shaped male tab is inserted into the female slot on an adjacent barrier. Locking pins are inserted through lower end upper extensions of the I-shaped male tab of the barrier near the bottom and the middle. The locking pins extend through both barriers such that the first and second barriers are secured together at the bottom and the middle. Another locking device is positioned at the top of the barrier which consists of a hinged locking bar held by a hinge pin. When the barrier is mated with an adjoining barrier, the hinged locking bar extends over the adjoining barrier to fit within a locking cavity. The locking bar is then secured to the other barrier to retain it in the locking cavity. The combination of the I-shaped male tab, the locking pin, and locking bar secure the top, the bottom, and the middle portions of the adjacent barriers together, thereby preventing the barriers from twisting and separating which in turn prevents a vehicle from breaking through the barrier.

30 Claims, 13 Drawing Sheets

INTERLOCKING BARRIER SYSTEM WITH MULTIPLE SECURING MECHANISMS

CROSS-REFERENCE TO RELATED APPLICATIONS

This application is a continuation-in-part of the commonly owned copending application entitled "Interlocking Barrier System With Upper And Lower Securing Mechanisms", filed Sep. 14, 1998, bearing U.S. Ser. No. 09/152,575 now abandoned and naming Gerald L. McCallum, the named inventor herein, as sole inventor, the contents of which is specifically incorporated by reference herein in its entirety.

BACKGROUND OF THE INVENTION

1. Technical Field

The present invention relates to roadway barrier systems. In particular, in relates to water filled barriers with upper, lower and central interlocking mechanisms to prevent vehicles from penetrating the barrier in the event of an accident.

2. Background Art

To control traffic in a variety of situations, such as construction, detours, or to separate lanes high-speed traffic, a variety of devices have been developed to prevent traffic from leaving the proper traffic line and entering an improper lane where an accident may occur. Once such set of devices comprises road barriers. The road barriers most often seen take one of two forms: solid concrete barriers or water filled barriers.

Concrete barriers were the among first to be developed. They provide a variety of features that are desirable in a barrier, such as substantial weight, simplicity of manufacture, and durability. While providing a practical solution for many applications, concrete barriers also have several drawbacks. For example, a concrete barrier is very heavy and requires special equipment to move and install it. In addition, since concrete barriers are often used on a temporary basis, the cost of moving these heavy objects is doubled due to the two trips required to install them and then to subsequently remove them. It would be desirable to have barrier which is light and easy to handle such that it would not require special equipment to be moved.

In addition to the problems caused by weight, concrete barriers typically do not have any interlocking mechanism to prevent them from separating upon impact by a vehicle. As a result, even though a barrier may be correctly placed, an out of control vehicle may climb over or push the barrier aside, penetrate another lane of traffic, and cause an accident. Attempts have been made to eliminate that problem. One attempt has been to form tabs in the ends of the barriers such that the weight of the adjacent barrier is used to help restrain the barrier from moving upon impact by a vehicle. However, barriers with tabs will typically disconnect from one another depending on the nature of the impact because the tabs are not positively secured.

To address problems related to the weight of the concrete barriers, an alternative lightweight barrier was developed. The lightweight barrier is typically fabricated from a synthetic material, such as plastic, polyethylene, polypropylene, or any other suitable material. These lightweight barriers are hollow structures that are easy to transport and manipulate. They do not need special equipment to be loaded onto or off of the transport vehicle. Further, they may be moved into position and adjusted by hand due to their light weight. Once the lightweight barriers are manually placed into position, they are filled with water resulting in a barrier which is equivalent in weight to a concrete barrier of similar size. At such time that the barrier is no longer needed, the water is drained from it. Once drained, the barrier is now light enough to be manually loaded onto a transport vehicle for removal. As a result, the inconvenience and expense resulting from the heavy weight of concrete barriers has been eliminated by the hollow water-filled barriers.

Unfortunately, existing water barriers have the same break through problem that concrete barriers have. In particular, when a vehicle strikes a water barrier it may push the barrier aside, enter another lane of traffic and cause an accident in the same manner that prior art concrete barriers did.

In the prior art barrier systems that use end tabs to connect adjacent barriers, the end tabs are typically positioned at the base of the barrier and provide limited resistance to movement of the barriers when impacted by a vehicle. In particular, if a vehicle strike's barrier at a higher location on the barrier wall, the barrier wall may separate and allow the vehicle to penetrate the barriers, enter an adjacent traffic lane and cause an accident. It would be desirable to have a barrier system in which adjacent barriers were secured at multiple points such that they would not separate if the barrier was struck by a vehicle at an unexpected height.

In attempting to deal with barrier separation problems, prior art systems have provided supplemental external devices that are used in conjunction with a barrier. One known system uses a form of metal exoskeleton that is secured to the outer surface of the barriers and extends across several barriers such that they are held together by the exoskeleton. Another known system uses cables that run across several barriers and are secured to several barriers in an attempt to prevent them from separating on impact. These systems add cost to the overall system and increase the amount of time required to install or remove the barriers. In addition, they generally secure only one area of the barrier. Because of this, if the barrier is struck in the right spot it may twist, resulting in separation from the adjacent barrier. It would be desirable to have a barrier structure that is resistant to separation and which does not require the installation of supplemental equipment such as complex exoskeleton or cable retention systems.

In addition to the safety problems caused by separation of barriers on impact, and the possibility of the exoskeleton, the cables, or the pins that hold the exoskeleton for the cables in-place, turning into projectiles upon impact by a vehicle, and the subsequent breakthrough of the vehicle into another lane traffic, prior art barrier systems typically have surfaces that are attractive to individuals for the purpose of printing graffiti because of the ease with which they may be written upon. As a result of the graffiti, many barriers become eyesores which result in additional expense due to the costs associated with having them cleaned. It would be desirable to have a barrier system which was resistant to graffiti.

When barriers are placed temporarily, for purposes such as construction, additional devices are usually used in conjunction with them. In particular, either warning lights or markers of some kind are used in conjunction with the barriers to provide warnings to motorists. It would be advantageous to have a barrier system that has an integral warning device to alert motorists of its presence.

While addressing some of the issues related to barrier systems, the prior part has failed to provide a barrier system which is lightweight, which is easy to manipulate by hand without special equipment, which is resistant to graffiti, and which has an integral warning system for motorists. More importantly, the prior art has failed to provide a barrier system that, when two barrier systems are joined together end-to-end, is resistant to separation upon impact by vehicle at any height due to multiple securing mechanisms at top, bottom and central locations.

SUMMARY OF THE INVENTION

The present invention solves the foregoing problems by providing a lightweight interlocking hollow barrier that is easy to transport to and from a work site. The hollow barrier is filled with water at the work site, and prior to being removed it is emptied. As a result, it does not require special equipment to deliver, install, or remove due to its low weight. The barrier includes interlocking mechanisms at both ends to prevent it from being disengaged from adjoining barriers if it is impacted by a vehicle. Each barrier has a unique male tab on one end and a matching female slot on the other end. The male tab on the barrier is inserted into the female slot on an adjacent barrier, while the male tab from the other adjoining barrier is inserted into the female slot on the barrier. The shape of the male tab secures the two barriers together such that the ability of the barriers to twist on impact is reduced.

In a preferred embodiment, the male tab is configured in an "I" shape in which wide upper and lower extensions on the tab are snugly fit into cavities in the female end of an adjacent barrier. The purpose of the upper and lower extensions is to prevent twisting of the barrier upon impact. The upper and lower extensions of the male tab on each barrier is secured to the adjacent barrier by locking pins that are inserted through a first side wall of the female end of the first barrier, through the upper and lower extensions of the male tab of the adjacent second barrier which was asserted into the female slot, and then through the second side wall of the female end of the first barrier. The locking pins, once inserted, extend through both sides of the female end of the first barrier and through the male tab such that the first and second barriers are secured together by the locking pins. The locking pins prevent the barriers from being disconnected at the base of the barrier and in the middle section of the barrier upon impact by vehicle.

A second locking mechanism is positioned at the top of the barrier. The second locking mechanism consists of a hinged locking bar that is held to the barrier by a hinge pin. When the barrier is mated with an adjoining barrier, the hinged locking bar is flipped from a storage cavity on the upper surface of the barrier and extended over the adjoining barrier to fit within a locking cavity in the top of the adjoining barrier. The locking bar is then secured to the other barrier to retain it in the locking cavity.

The locking bar works in concert with the mail tab to secure the bottom, middle and the top of the adjoining barriers together. As a result, if the barrier is impacted, the combination of the male tab with upper and lower extensions, the locking pin, and the locking bar secure the top, the bottom, and the middle portions of the adjacent barriers together, thereby preventing the barriers from twisting, which in turn prevents the vehicle from breaking through the barrier into another traffic lane and potentially causing an accident.

The invention also provides a roughened exterior surface that is resistant to graffiti. The surface is roughened to prevent writing from being applied to the surface evenly. Since writing cannot be applied to the surface evenly, it is more difficult for graffiti to be legibly applied. One section of the exterior surface of the barrier may be left flat to provide an area where warning devices can be applied to warn motorists of potential danger. In the preferred embodiment, a strip of reflective tape is applied to the flat area of the exterior surface of the barrier. Optionally, a section of barrier can be indented to provide a cavity that can hold control circuits for Electro-luminescent lamps or back-lit LCDs. The control circuits are mounted within the barrier to prevent it from becoming a projectile in the event of an accident.

The barrier also has a series of pressure relief holes and plugs on the top which when subjected to pressure caused by an impact will rupture and release water. The pressure relief holes allow the barrier to absorb some of the force of the impact, thereby reducing the danger to the motorist. In addition, a series of structural support rods extend between the opposing side walls and secure the opposing side walls together to prevent pressure from the water inside the barriers from bowing the walls.

DESCRIPTION OF THE PREFERRED EMBODIMENT

Figure 1:
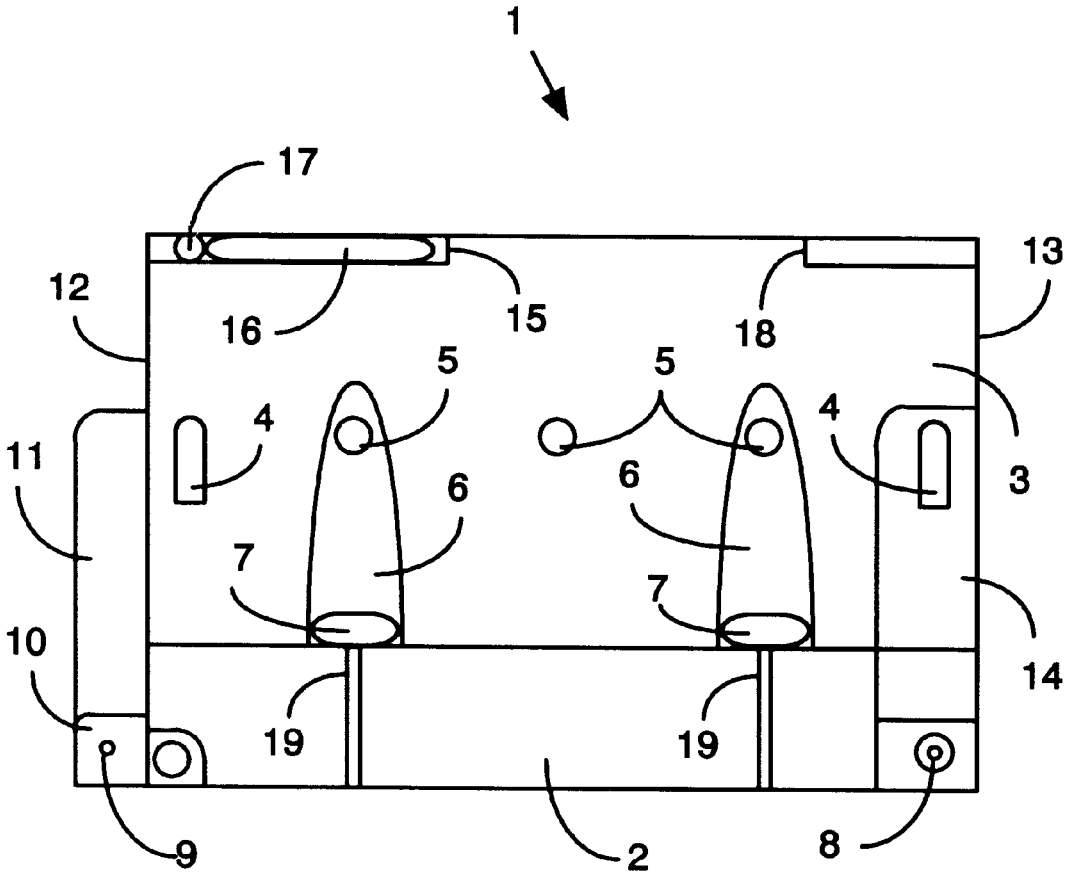
FIG. 1 is a side view of a preferred embodiment of the barrier illustrating the T-shaped male tab, the location of the locking pin, and the location of the locking bar.

In FIG. 1, a side view of a preferred embodiment of the interlocking barrier 1 is shown. In this view, a widened base 2 provides a stable support for the interlocking barrier 1. The lower portion is oriented vertically to redirect a vehicle tire when it impacts the barrier 1 for the purpose of reducing the possibility that the vehicle will climb up the wall of the barrier 1. An upper wall 3 slopes inward and upward from the widened base 2. The upper wall 3 slopes upward at an angle for the purpose of absorbing some of the impact of a vehicle. When a vehicle impacts the interlocking barrier 1, it will strike the upper wall 3 gradually disbursing force of the impact to protect the motorist. If the side wall of the interlocking barrier 1 was flat, the vehicle would deliver all of its energy without any reduction in force due to the deflection of the vehicle.

Also shown are handle apertures 4. The handle apertures 4 extend through the interlocking barrier 1, and provide a place to insert handles (not shown) that workmen can use to lift and carry the interlocking barrier 1. The handles may be any device, for example, a board. Retaining bar channels 19 are used to provide a place to secure retaining bars (not shown). The retaining bars would typically be rebar, but they could be fabricated from any suitable material. In the situation where the interlocking barrier 1 was resting on unpaved ground, the retaining bars would be driven into the ground to further secure the interlocking barrier 1.

Apertures 5 provide structural support by providing a rigid connection in the two side walls of the interlocking barrier 1. They reduce the chance of warping due to water pressure.

Concave segments 6 add structural strength to the interlocking barrier 1 and help to prevent water pressure inside the interlocking barrier 1 from damaging or warping the side of the interlocking barrier 1. Apertures 7 provide an additional location for workmen to grasp or carry the interlocking barrier 1. In addition, apertures 7 may be used to insert ropes or tie downs to secure the interlocking barrier 1 when it is being transported.

Locking pin 8 is shown inserted into the female end 13 of the interlocking barrier 1. The location of the female slot 14 is shown in dashed lines for ease of illustration. Male tab 11 shown on the male end 12 of the interlocking barrier 1. Male tab 11 has a widened foot segment 10 which is used in conjunction with locking pin 8 that is inserted through pin aperture 9 when two interlocking barriers 1 are secured to one another. Also shown in this figure are storage cavity 15 and locking cavity 18. Locking bar 16 is shown attached to locking bar hinge 17. The locking bar 16 is shown in the storage position which is where it would be located during transit or prior to attachment to an adjoining interlocking barrier 1. The locking bar 16, locking bar hinge 17, locking bar storage cavity 15, and locking cavity 18 are shown in dashed lines because they would not be visible from the side.

Figure 2:
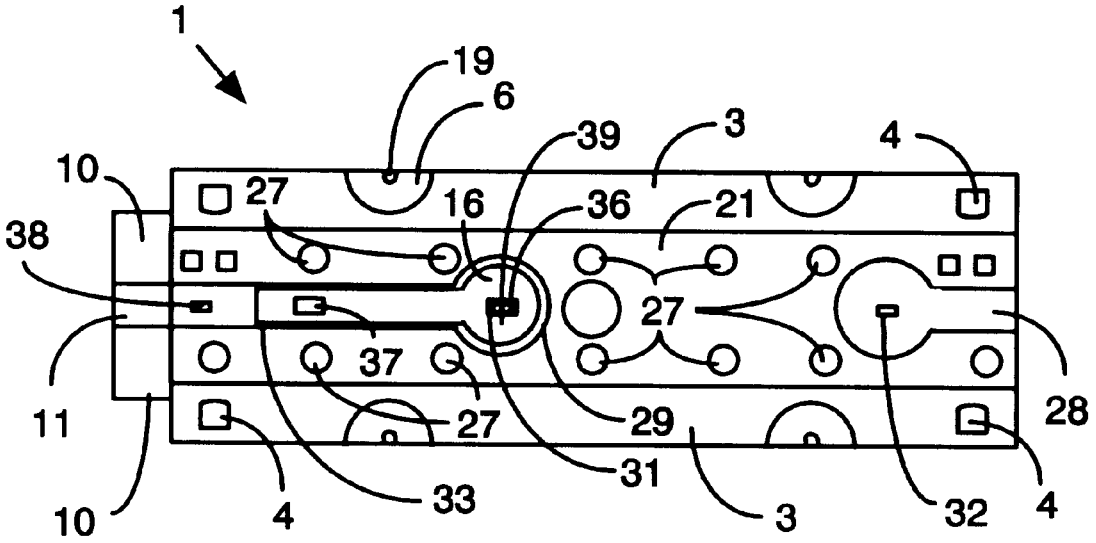
FIG. 2 is a top view of a preferred embodiment of the barrier illustrating the locking bar in the storage position, the location of the locking cavity, and the location of the retaining pin apertures.

FIG. 2 is a top view of a preferred embodiment of the invention. In this figure, the upper surface 21 is shown. Male tab 11 and widened foot segment 10 are shown extending from the end of interlocking barrier 1. The T-shape formed by the vertical section of the male tab 11 and its widened foot segment 10 reduce the possibility that adjoining barriers 1 will twist apart in the event of an impact.

Locking cavity 28 is shown on the female end of interlocking barrier 1. When the barrier 1 is attached to an adjoining barrier 1, the locking bar 16 from the adjoining barrier 1 will snap into the locking cavity 28 and by secured to locking clamp 32 in locking cavity 28. Storage cavity 29 is located on the male end of the upper surface 21. Also shown in storage cavity 29 is locking clamp 36. Locking bar 16 is attached to locking hinge 33 and shown in the storage position with locking clamp 36 extending through locking clamp aperture 31. When locking bar 16 is flipped from the storage position to the locked position, it extends to the locking cavity 28 of the adjoining barrier 1 and its locking clamp aperture 31 is secured to the locking clamp 32 of the adjoining barrier 1. In addition, locking clamp aperture 37 is secured by locking clamp 38. As a result, the locking bar 16 is secured by locking clamps 38 on barrier 1 and the locking clamp 32 on the adjoining barrier 1. Any suitable method may be used to implement locking clamps 32, 36, 38. In the preferred embodiment, locking clamps 32, 36, 38 are fabricated from the same material the barrier is made from. The locking clamps 32, 36, 38 have apertures to accept a lock or retaining pin 39 (for example, a cotter pin).

Also shown in this figure are pressure relief holes 27. These holes are formed in the surface of the interlocking barrier I and sealed with specially designed plugs. In the event of an accident, the water pressure inside the interlocking barrier 1 would press against the plugs which would burst from their holes, releasing water through the top of interlocking barrier 1. The release of water would have the effect of distributing some of the force of impact, thereby reducing the risk of injury to the motorist.

Figure 3:
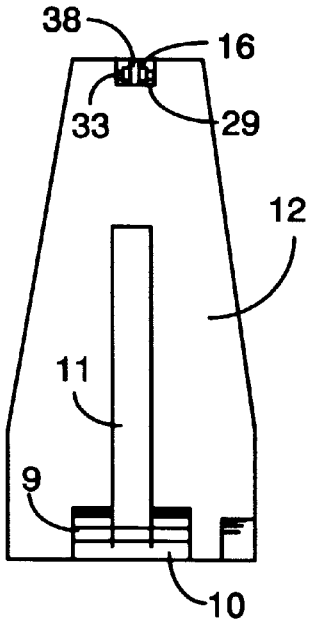
FIG. 3 is an end view of a preferred embodiment of the barrier showing location of the T-shaped male tab and the location of the locking pin.

In FIG. 3, an end view of a preferred embodiment of the male end 12 of the interlocking barrier 1 is shown. As can be seen in this figure, male tab 11 and widened male foot segment 10 project outward from the surface of male end 12. Also shown in this figure is an end view of the storage cavity 29. Locking hinge 33 is shown attached to the locking bar 16 and interlocking barrier 1. Locking clamp 38 is shown in front of locking bar 16. Pin aperture 9 is shown in dashed lines to illustrate its path through the widened foot segment 10 of male tab 11.

Figure 4:
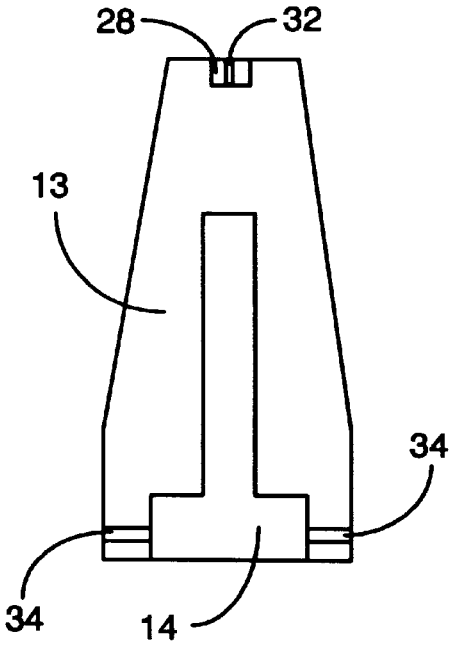
FIG. 4 is an end view of preferred embodiment of the barrier showing location of the female slot and the locking pin.

FIG. 4 is an end view of the female end 13 of a preferred embodiment of the interlocking barrier 1. This figure illustrates female slot 14 into which the male tab 11 is inserted. Also shown are channels 34 which align with pin aperture 9 to form a channel for locking pin 8. At the top of the figure is shown locking cavity 28 with locking clamp 32. Locking cavity 28 and storage cavity 29 of an adjoining interlocking barrier 1 will align with one another such that locking bar 16 can pivot on locking hinge 33 when moving from the storage position to the locked position. In the preferred embodiment, locking bar 16 is fabricated from the same material as the barrier 1.

As can be seen from FIGS. 3 and 4, the locking pin 8 and the locking bar 16 combine to secure adjacent interlocking barriers 1 to one another at the top and the bottom. In addition, the male tab 10 secures the middle segment of the interlocking barrier 1 and the widened male foot segment 10 secures the bottom of the interlocking barrier 1. As a result, the interlocking barrier 1 is secured to the adjacent interlocking barrier 1 such that is secured at the top, in the middle, and at the bottom. Because it is secured in this manner, if a vehicle impacts the interlocking barrier 1 it will not twist and break free resulting in the vehicle passing through the barrier and into another lane of traffic. As a result, this more complete method of securing adjacent interlocking barriers 1 to one another, without the use of exoskeletons or steel cables and pipes, overcomes the problems of the prior art which permitted barriers to twist and separate, resulting in vehicles passing dangerously into other traffic lanes. Further, the components used to fabricate the exoskeletons, steel cables and pipes could themselves become projectiles if impacted.

Figure 5:
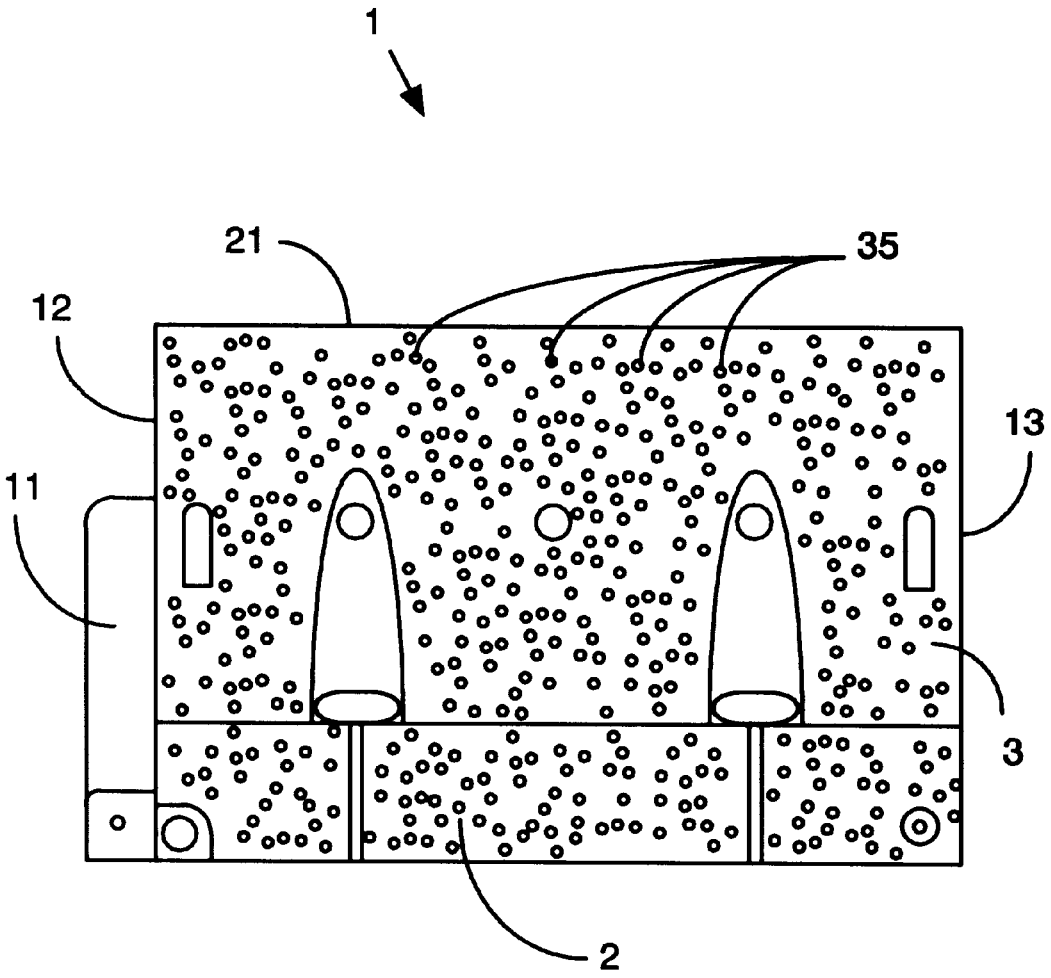
FIG. 5 is a side view of an alternative embodiment of the invention illustrating the roughened surface used to discourage graffiti.

Referring to FIG. 5, this figure illustrates an alternate preferred embodiment in which the outer surface of interlocking barrier 1 is formed with a roughened surface 35. The roughened surface 35 prevents graffiti from being easily written on it. This reduces the amount of work required to maintain the interlocking barrier 1 in a good appearing condition.

Figure 6:
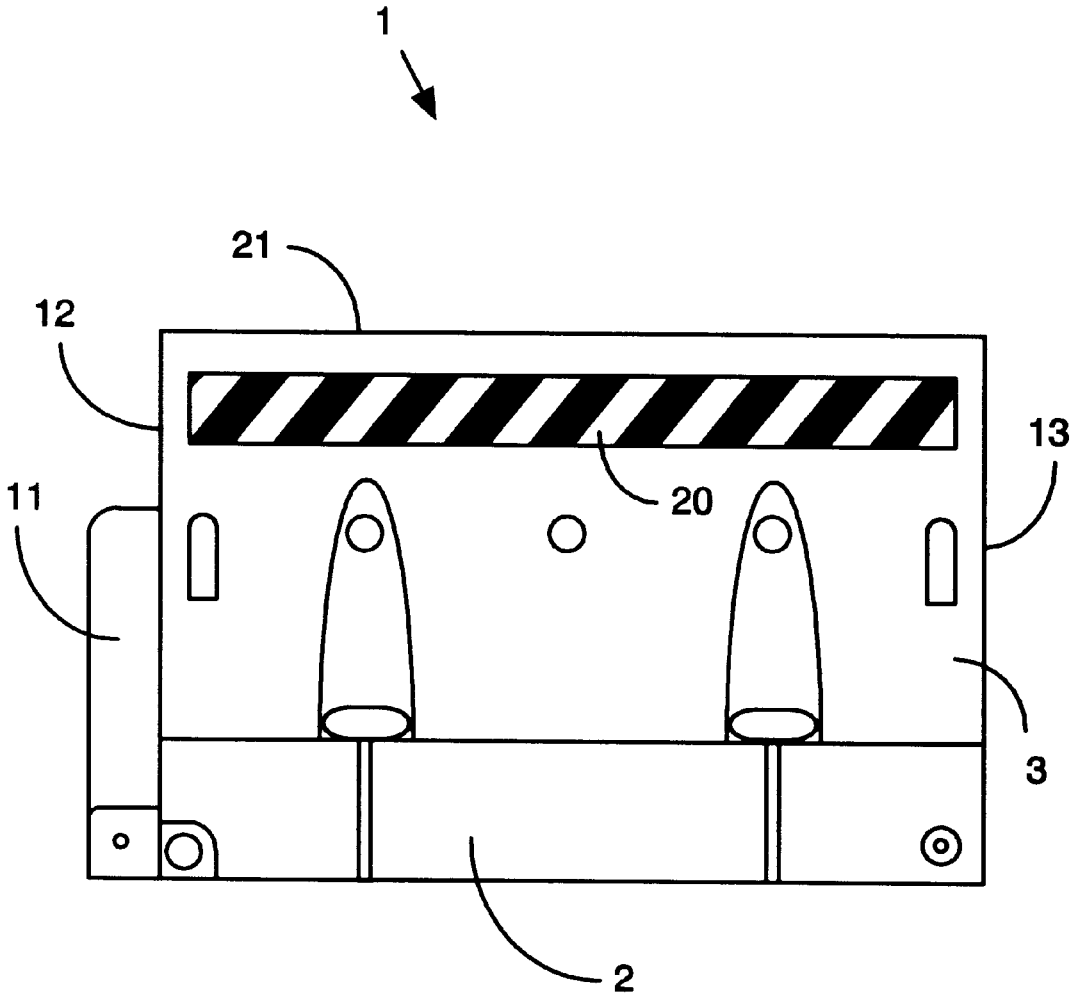
FIG. 6 is a side view of an alternative embodiment of the invention that shows a reflective strip mounted in the surface of the barrier that acts as a warning device. The barrier surface has a smooth portion sized to accept the reflective strip.

Another alternative preferred embodiment is shown FIG. 6. In this figure, a reflective strip 20 of material is adhered to the interlocking barrier 1 near its top edge. The reflective strip 20 warns motorists that a potential hazard is present. Those skilled in the art will recognize that the reflective strip 20 can be used in conjunction with other features such as the roughened surface 35 of the previous embodiment.

Figure 7:
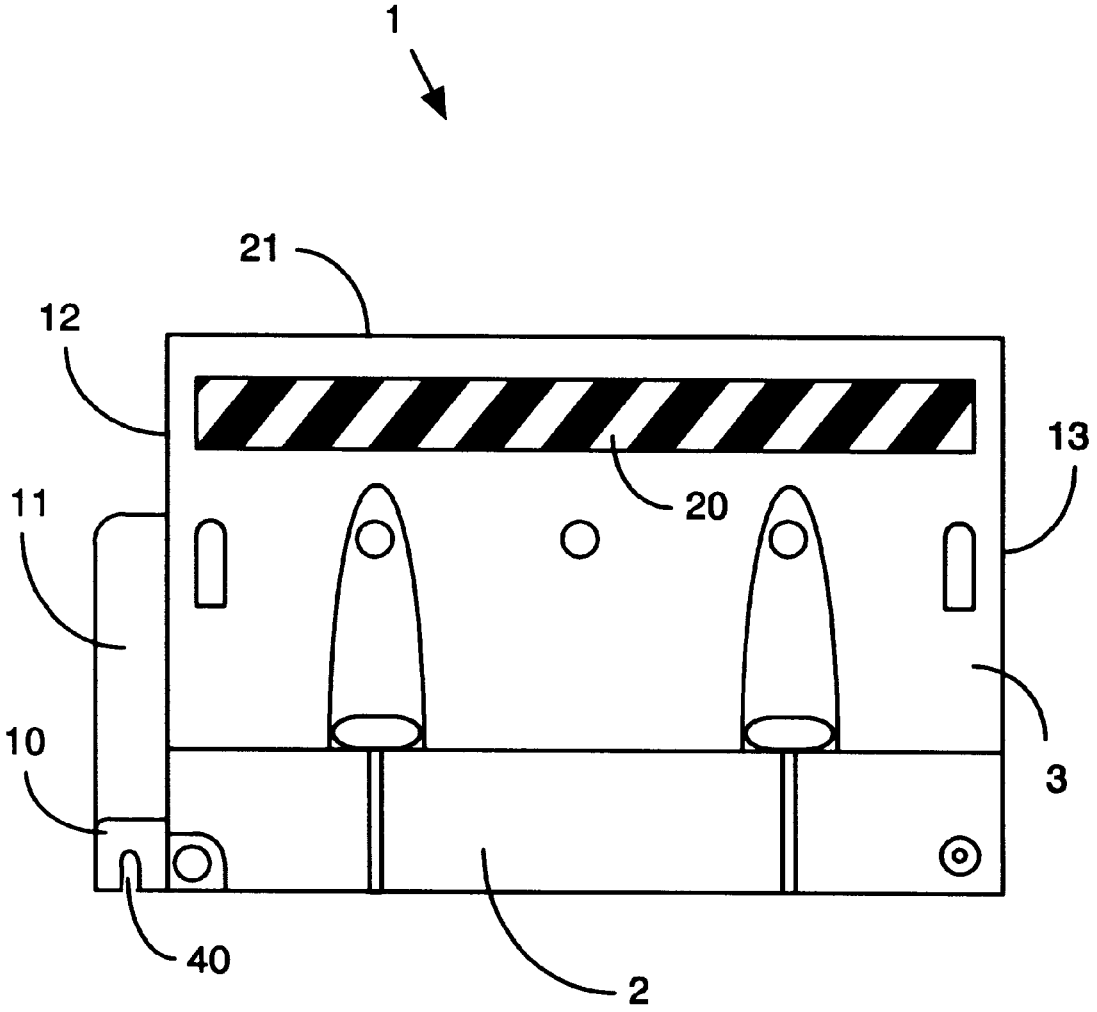
FIG. 7 is an alternative embodiment of the invention in which the T-shaped male tab uses a groove to attach to the locking pin.

In FIG. 7, another alternative preferred embodiment is shown. In this embodiment, the T-shaped male tab has a groove 40 on the bottom of the male tab rather than a pin aperture 9 for the locking pin. The advantage of using a groove 40 instead of a pin aperture 9 is that it is easier for a workman to attach or detach a barrier 1 from an adjoining barrier 1 by lifting the barrier over the locking pin 8 rather than having to insert of remove the locking pin 8.

Figure 8:
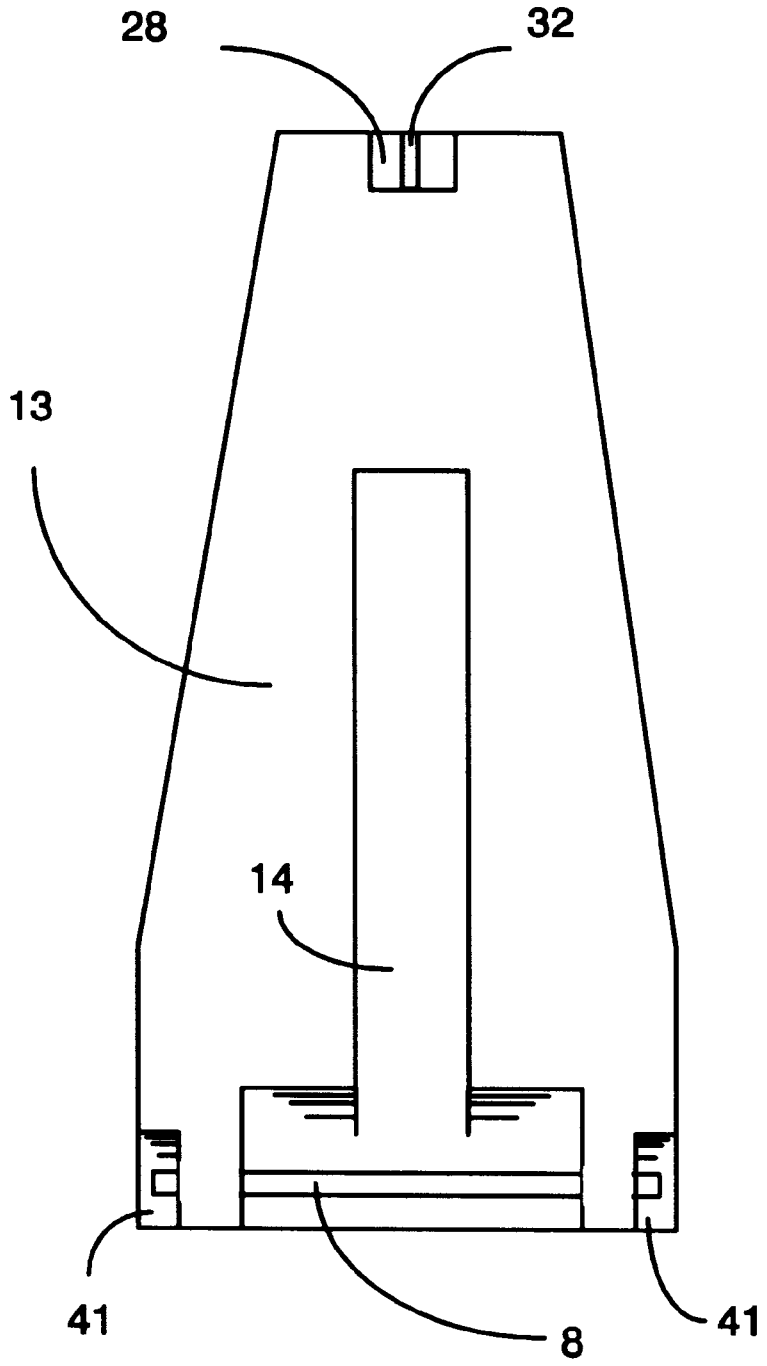
FIG. 8 illustrates an alternative embodiment of the invention showing the locking pin in the bottom of the female groove for the T-shaped male tab.

FIG. 8 illustrates an alternative embodiment in which locking pin 8 is installed in the female slot 14 of barrier 1. In this embodiment, the T-shaped male tab 10, 11 of an adjacent barrier 1 is attached to barrier 1 by lifting the adjacent barrier 1 up and sliding it into the female slot 14 until the groove 40 of the adjacent barrier 1 is able to be installed on locking pin 8. Indented areas 41 are used to allow installation of the locking pin 8 without having it protrude from the outer surface of the barrier 1.

Figure 9:
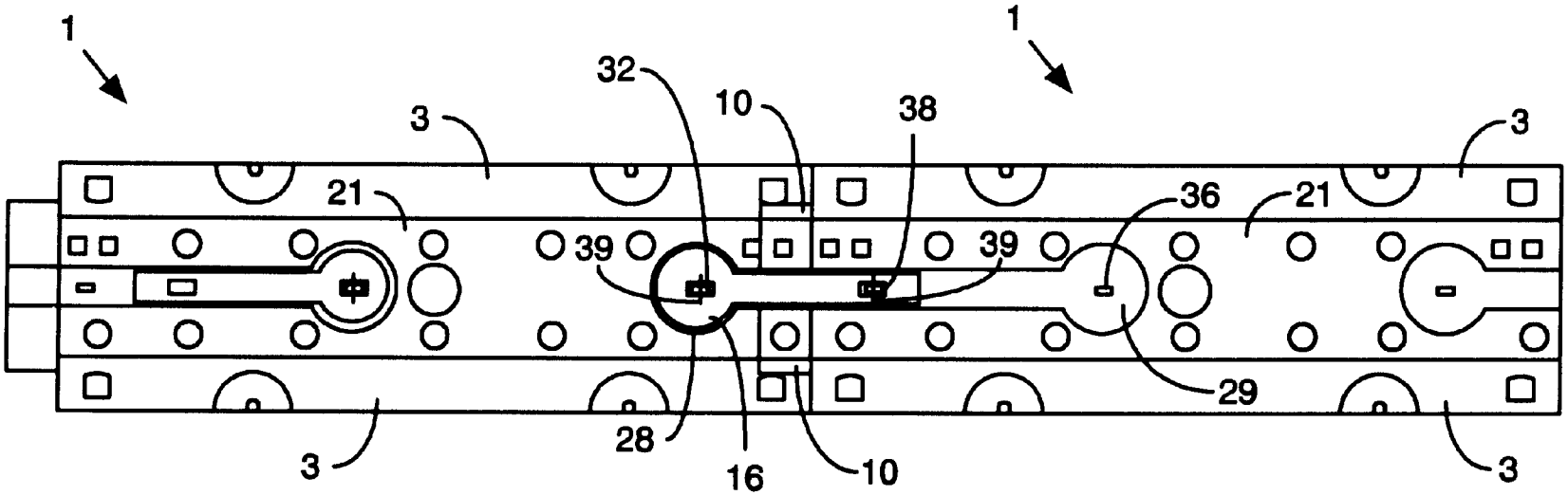
FIG. 9 illustrates a top view of a preferred embodiment of the invention showing two barriers secured together with the locking bar in place.

In FIG. 9, a top view illustrating two barriers 1, secured together, is shown. In this view, locking bar 16 is shown in the locked position. In the locked position, locking bar 16 is snugly snapped into place in the locking channel 28 of the adjacent barrier 1. The locking bar 16 is further secured by retaining pins 39 attached to locking clamps 32, 38. The T-shaped male tab 10, 11 is shown in dashed lines to illustrate its position when the barriers 1 are attached to one another. The locking bar 16, when secured in the locked position, prevents the top of the adjacent barriers 1 from separating when impacted. As a result, the vehicle is prevented from passing into another lane of traffic.

Figure 10:
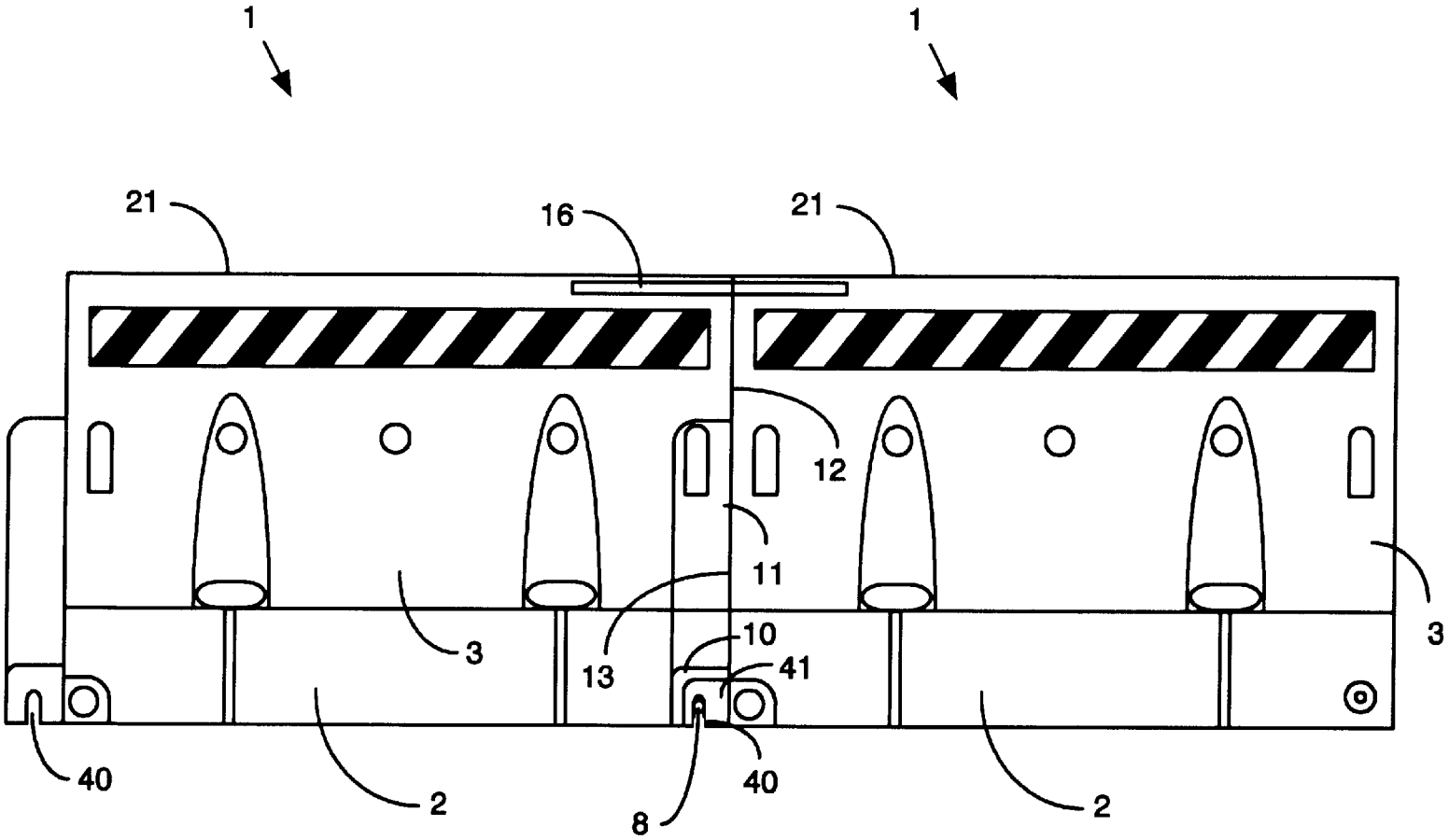
FIG. 10 illustrates a side view of a preferred embodiment of the invention showing two barriers secured together with the locking pin and locking bar in place.

In FIG. 10, a side view illustrating two barriers 1, secured together, is shown. In this view, locking bar 16 is shown in the locked position. The T-shaped male tab 10, 11 is shown in dashed lines to illustrate its position when the barriers I are attached to one another. The locking bar 16 is shown in dashed lines to illustrate it securing the top of the two barriers 1 together. In addition, the locking pin is shown securing the bottom of the barrier 1. In the locked position, the groove 40 in the T-shaped male tab 10, 11, is installed over the locking pin 8, and the locking bar prevents the barrier 1 from moving such that the T-shaped male tab 10, 11 can disengage from the locking pin 8. The locking bar 16, when secured in the locked position, prevents the bottom of adjacent barriers 1 from separating when impacted. As a result, the vehicle is prevented from passing into another lane of traffic.

Figure 11:
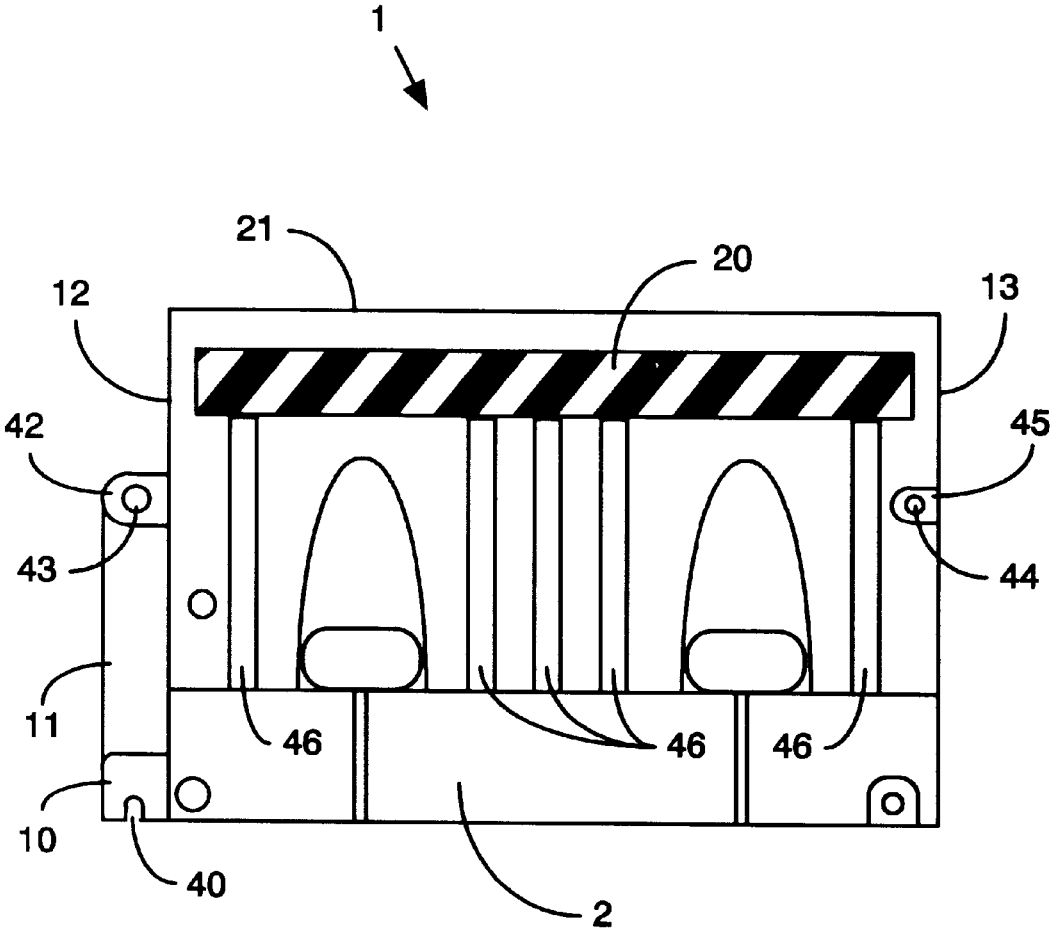
FIG. 11 is the side view of an alternative preferred embodiment of the invention in which the male tab has a first extension near the bottom of the barrier, a second extension located in the central area of the barrier.

Regarding FIG. 11, this alternative preferred embodiment is an improvement over the preceding embodiments in that it adds an additional securing mechanism to the middle section of the barrier, and improves the structural stability constraint of barrier 1 by preventing bulging and failure of the barrier 1 in its mid section with support ribs 46 that further enhance its ability to avoid separation from adjacent barriers 1 upon impact in the event of an accident.

T-shaped male tab 11 of the previous embodiments has been replaced with an I-shaped male tab 11. I-shaped mail tab 11 has the same lower extension 10 at its bottom that was used in the previous embodiments. In addition, male tab 11 an upper extension 42 near it's top. The advantage of using upper and lower extensions 11, 42 instead of a single lower extension 11 is that when interlocking barrier 1 is impacted by a vehicle, it is more difficult to separate from an adjoining interlocking barrier 1. In addition, while groove 40 is used in conjunction with a locking pin in the same manner as was done in the previous embodiments, aperture 43 of a first interlocking barrier 1 is used in conjunction with aperture 44 of an adjacent interlocking barrier 1 to support an additional locking pin that secures the middle section of two adjacent interlocking barriers 1 together.

A locking bar 16 is used in this embodiment in the same manner as it was used in the embodiments discussed above. When used in combination with the locking bar 16, the upper and lower extensions 10, 42 of male tab 11 act together to secure adjacent interlocking barriers 1 at the top, at the bottom, and in the middle. The three components of this securing system provide positive locking of adjacent barriers 1 by securing them at the top, at the middle, and at the bottom. The bottom ends of adjacent barriers 1 are secured via lower extension 10 and its corresponding female slot 14. This section is further secured by the insertion of a locking pin 8 to prevent disengagement of lower extension 10 from the female cavity 14 of the adjacent barrier 1. The middle section of the ends of adjacent barriers I are secured via upper extension 42 and its corresponding female cavity 14 in the adjacent barrier 1. As was the case above, upper extension 42 can be further secured to the adjacent barrier 1 via insertion of a locking pin 8 to prevent disengagement of upper tension 42 from the female cavity 14 in the adjacent barrier 1. Finally, the upper sections of the ends of adjacent barriers 1 are secured together by the positive locking action of locking bar 16. When locking bar 16 is folded over, it fits into corresponding locking cavity 28 on the top of the adjacent barrier 1. In practice, the locking bar 16 designed to snap in place to be held via a pressure fit. However it also allows for the insertion of the retaining pin 39 which further secures it to the adjacent barrier 1.

The combination of the I-shaped male tab 11 together with locking bar 16 provides the ability to positively secure adjacent barriers I together top, middle, and bottoms of barrier 1 end. By securing adjacent barriers 1 together in this matter, possibility that adjacent barriers 1 separate on impact is greatly reduced. In addition, the use of locking pins 8 in combination with retaining pin 39 further reduces the possibility of separation upon impact. This method of using a three fold approach to securing adjacent interlocking barriers 1 results in a system that is much less likely to fail under pressure of an impact and become disengaged. This results in a much safer barrier system which prevents vehicles from crashing through the barrier system to cause an accident in an adjacent traffic lane.

Another optional feature of the invention is the use of support ribs 46. The support ribs 46 project inward into the body cavity of barrier 1. The effect of the support ribs 46 is that they add structural stability and strength to the side walls of the barrier 1. The added strength reduces the possibility that the weight of the water inside the barrier 1 will result in wall failure or outward bowing of the side wall of the barrier 1. By maintaining the correct shape of the barrier 1, the alignment of adjacent interlocking barriers 1 is improved and the possibility of penetration by a vehicle, upon impact, is further reduced.

Those skilled in the art will recognize the locking pins 8 used in this and the previous embodiments can be omitted and the interlocking structure provided by the male tab 11 will still act to prevent the interlocking barriers I from becoming disengaged upon impact. However, locking pins 8, when placed in the upper and lower extensions 10, 42 of male tab 11 will act to further strengthen adjacent interlocking barriers 1 and prevent them from becoming disengaged. The barrier I will also operate effectively if the storage and locking cavities are omitted and the locking bar 16 is mounted on the surface of the barrier 1. However, the locking cavity is desirable in that it allows the locking bar 16 to have the additional support provided by the locking cavity when the locking bar is snugly inserted into it. Likewise, an important feature this invention is the ability to positively connect adjacent barriers 1 at their tops via locking bar 16. Heretofore, the prior art has failed to provide in upper securing mechanism which can be positively secured (for example, via retaining pin 39) to adjacent barrier and then easily disconnected at such time as the barriers 1 are to be moved.

Figure 12:
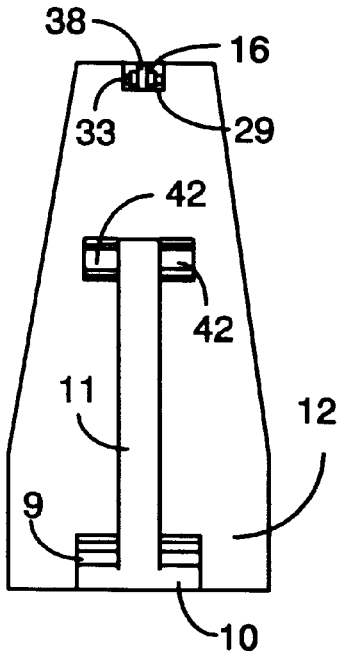
FIG. 12 is an end view of the embodiment of FIG. 11 in which the male end is shown. The male tab is shown with upper and lower extensions. In addition, the locking bar the shown on the top of the barrier.

In FIG. 12, an end view of the preferred embodiment of FIG. 11 is shown. As can be seen in this figure, male tab 11 and widened male foot segment 10 (i.e. a "lower extension") that projects outward from the surface of male end 12 and further projects laterally from male tab 11. In addition to lower extension 10, upper extension 42 is also shown. The addition of upper extension 42 improves the stability of the interlocking barrier 1 by reinforcing and stabilizing its central section, and also reducing any leverage between upper locking bar 16 and lower extension 11 based on the distance between them. The upper extension 42 helps the interlocking barrier 1 in resisting twisting motion which comes is a result of the impact of a vehicle. The locking bar 18 completes the securing together of adjacent interlocking barriers 1 by providing the third locking point at the top of the interlocking barrier 1.

Those skilled in the art will recognize that while the preferred embodiment illustrates the lower extension 10 and the upper extension 42 as having different lengths, the lengths of lower extension 10 and the upper extension 42 can vary independent of one another. Likewise, the upper extension 42 does not have to be precisely positioned in the middle of interlocking barrier 1. It is only important that it is positioned in the approximate middle of the interlocking barrier 1 for the purpose of providing stability to the middle section of interlocking barrier 1.

Figure 13:
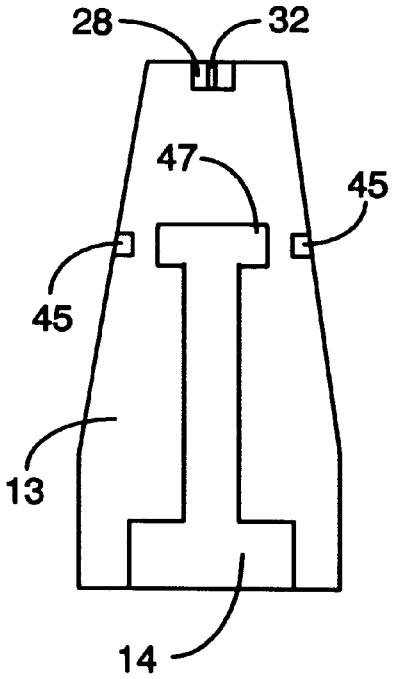
FIG. 13 is an end view of the embodiment of FIG. 11 in which the female end the shown. The cavity for the male tab has extended cavities that the top and bottom to accommodate the upper and lower extensions of the male tab.

FIG. 13 is an end view of the female end 13 of a preferred embodiment of the interlocking barrier 1. This embodiment corresponds to the embodiments of FIGS. 11 and 12, discussed above. This figure illustrates female slot 14 into which the male tab 11 is inserted. Female slot 14 in this embodiment has an additional cavity 47 which is designed to snugly fit upper extension 42 of an adjacent interlocking barrier 1.

This was the case in the previous embodiments, channels 34 are shown which align with pin aperture 9 to form a channel for locking pin 8. At the top of the figure is shown locking cavity 28 with locking clamp 32. Locking cavity 28 and storage cavity 29 of an adjoining interlocking barrier 1 will align with one another such that locking bar 16 can pivot on locking hinge 33 when moving from the storage position to the locked position. In the preferred embodiment, locking bar 16 is fabricated from the same material as the barrier 1, but may be fabricated from any suitable material.

As can be seen from FIGS. 12 and 13, the locking pin 8 and the locking bar 16 combine to secure adjacent interlocking barriers 1 to one another at the top and the upper and lower extensions 10, 42 secure adjacent interlocking barriers 1 together at the bottom and middle, respectively. This more complete method of securing adjacent interlocking barriers 1 to one another at several points, without the use of exoskeletons or steel cables and pipes, overcomes the problems of the prior art which permitted barriers to twist and separate, resulting in vehicles passing dangerously into other traffic lanes.

Figure 14:
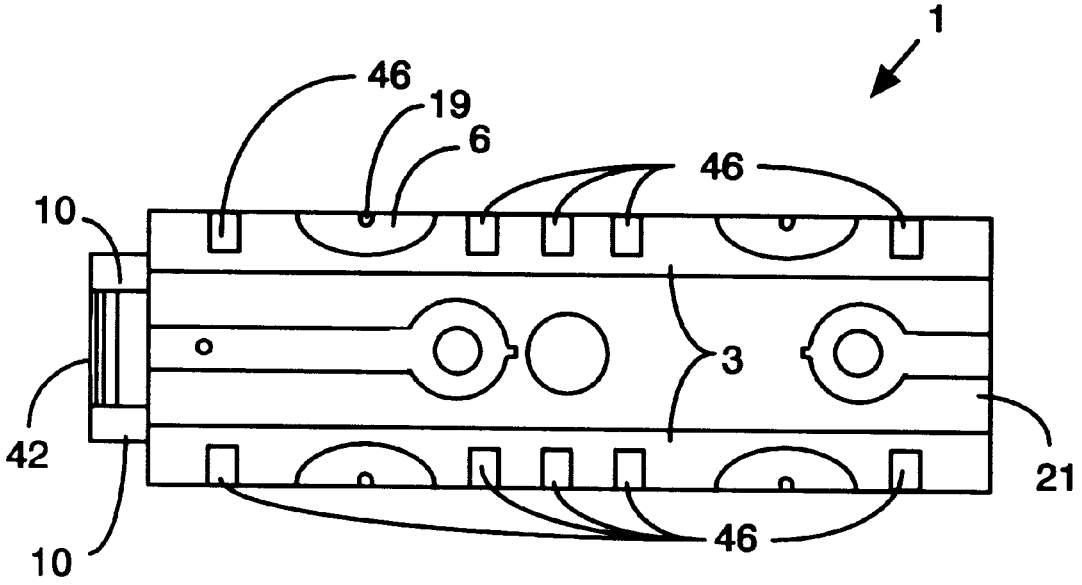
FIG. 14 is a top view of the embodiment of FIG. 11 which illustrates the position of the locking bar, and the upper and lower extensions on the male tab.

FIG. 14 is a top view of the preferred embodiment FIGS. 11–13. This figure illustrates the location of the upper lower extensions 42, 10 of the interlocking barrier 1, location of the cavity used to hold the locking bar.

Figure 15:
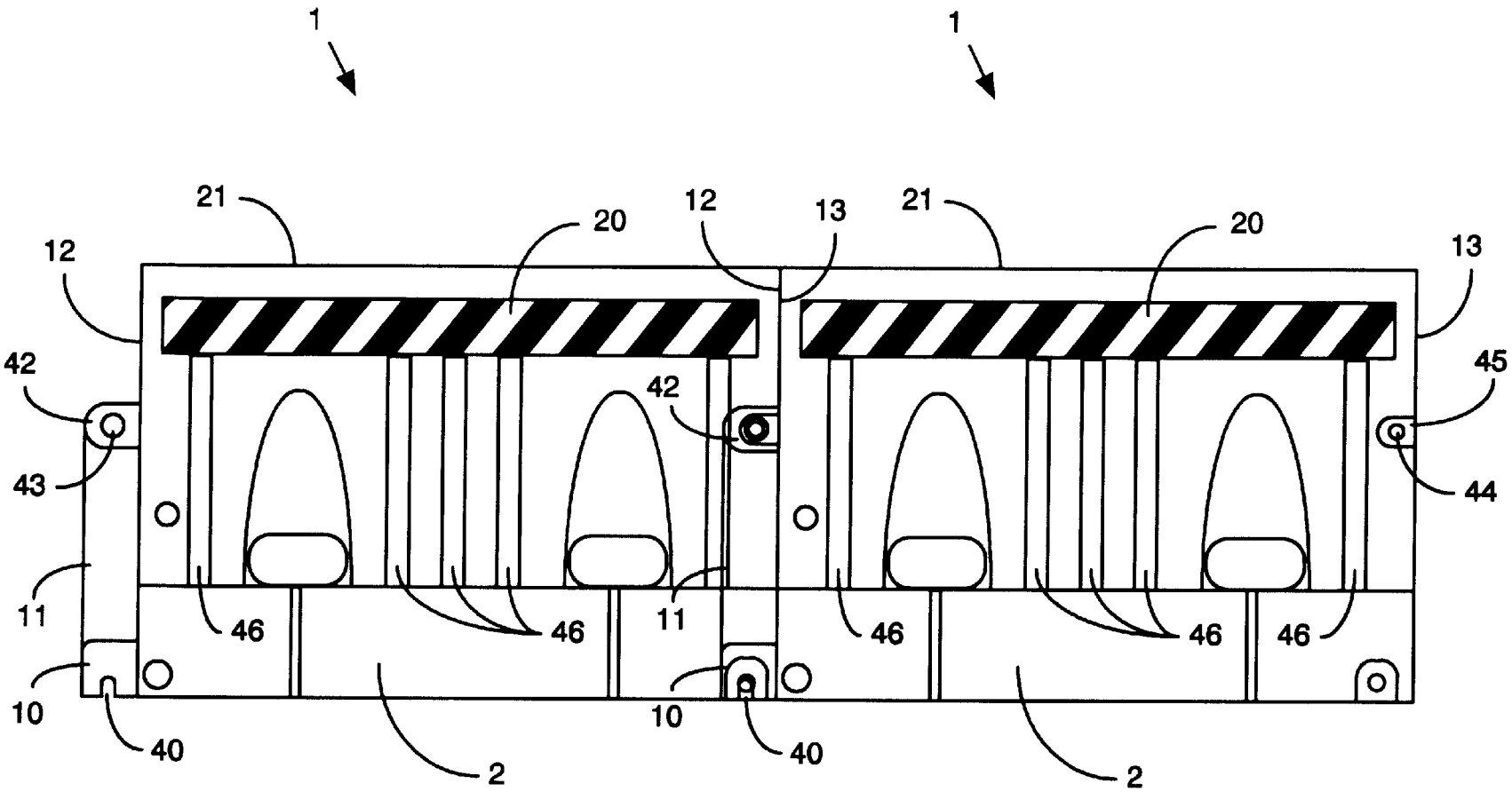
FIG. 15 is a transparent side view of the embodiment FIG. 11 in which two adjacent barriers are attached together.

In FIG. 15, two interlocking barriers 1 of the preferred embodiment of FIGS. 11–14 are shown. This illustration is a transparent view which illustrates the position the male tab 11 and the upper and lower extensions 42, 10 when the adjacent interlocking barriers 1 are joined. As can be seen, the male and female ends are aligned such that locking pins 8 can be inserted into the upper and lower extensions 42, 10 to positively secure them together.

While the invention has been described with respect to a preferred embodiment thereof, it will be understood by those skilled in the art that various changes in detail may be made therein without departing from the spirit, scope, and teaching of the invention. For example, the material used to construct the interlocking barrier 1 may be anything suitable for the task, the size and shape of the interlocking barrier may vary. Accordingly, the invention herein disclosed is to be limited only as specified in the following claims.

I claim:

1. An interlocking barrier that is secured at the top, middle and bottom, comprising:

a male end having locking means near the bottom, middle, and top of the male end, further comprising:

an I-shaped male tab having a lower extension and an upper extension on the male end of the interlocking barrier, the lower extension of the I-shaped male tab forming the locking means near the bottom of the male end and the upper extension of the I-shaped male tab forming the locking means near the middle of the male end; and a locking bar secured to the top of the male end and extending outward from the male end for attachment to the upper surface of an adjacent interlocking barrier;

a female end having locking means near the bottom, middle, and top, further comprising:

an I-shaped female slot having a lower extension and an upper extension on the female end of the interlocking barrier and located to accept the I-shaped male tab of an adjacent interlocking barrier such that when the I-shaped male tab of the adjacent barrier is inserted into the female slot of the barrier, the barriers are securely held; and means to secure the locking bar from an adjacent interlocking barrier to the top of the female end of the interlocking barrier;

whereby the end of the interlocking barrier is secured to the end of another interlocking barrier at the top, the middle, and the bottom.

2. An interlocking barrier, as in claim 1, wherein:

the locking bar is attached to top of the interlocking barrier via a hinge, and;

the locking bar can be hingedly moved from an attached position in which it extends outward from the end of the interlocking barrier over the end of an adjacent interlocking barrier, to a storage position in which it is hingedly folded back such that it does not extend over the end of the interlocking barrier.

3. An interlocking barrier, as in claim 2, further comprising a storage cavity in the male end of the interlocking barrier, the storage cavity sized to accept the locking bar when the locking bar is moved to the storage position.

4. An interlocking barrier, as in claim 3, further comprising a locking cavity in the female end of the interlocking barrier, the locking cavity sized to accept the locking bar when the locking bar is moved to the storage position.

5. An interlocking barrier, as in claim 4, further comprising:

a retaining clamp in the top of the locking cavity;

an aperture in the locking bar, the aperture sized to allow the retaining clamp to project through the locking bar of an adjacent interlocking barrier when the locking bar is in the attached position; and a retaining pin, the retaining pin detachably attachable to the retaining clamp when the locking bar of an adjacent interlocking barrier is attached to the interlocking barrier such that the locking bar of the adjacent interlocking barrier is prevented from being detached from the interlocking barrier.

6. An interlocking barrier, as in claim 5, further comprising:

an upper locking pin extending, when the interlocking barrier is attached to an adjacent interlocking barrier, through the upper extension of the male tab of the interlocking barrier and the female end of the adjacent interlocking barrier such that the upper extension is prevented from being detached from the female end of the adjacent barrier; and a lower locking pin extending, when the interlocking barrier is attached to an adjacent interlocking barrier, through the lower extension of the male tab of the interlocking barrier and the female end of the adjacent interlocking barrier such that the upper extension is prevented from being detached from the female end of the adjacent barrier.

7. An interlocking barrier, as in claim 6, further comprising a plurality of support ribs, extending inward from the side wall of the interlocking barrier;

whereby the support ribs prevent the side walls of the interlocking barrier from bowing under pressure.

8. An interlocking barrier, as in claim 2, further comprising:

a retaining clamp in the top of the locking cavity;

an aperture in the locking bar, the aperture sized to allow the retaining clamp to project through the locking bar of an adjacent interlocking barrier when the locking bar is in the attached position; and a retaining pin, the retaining pin detachably attachable to the retaining clamp when the locking bar of an adjacent interlocking barrier is attached to the interlocking barrier such that the locking bar of the adjacent interlocking barrier is prevented from being detached from the interlocking barrier.

9. An interlocking barrier, as in claim 8, further comprising:

an upper locking pin extending, when the interlocking barrier is attached to an adjacent interlocking barrier, through the upper extension of the male tab of the interlocking barrier and the female end of the adjacent interlocking barrier such that the upper extension is prevented from being detached from the female end of the adjacent barrier; and a lower locking pin extending, when the interlocking barrier is attached to an adjacent interlocking barrier, through the lower extension of the male tab of the interlocking barrier and the female end of the adjacent interlocking barrier such that the upper extension is prevented from being detached from the female end of the adjacent barrier.

10. An interlocking barrier, as in claim 9, further comprising a plurality of support ribs, extending inward from the side wall of the interlocking barrier;

whereby the support ribs prevent the side walls of the interlocking barrier from bowing under pressure.

11. A method of securing a barrier with an adjacent barrier at the top, middle and bottom of the barrier, including the steps of:

forming a barrier with a male end and an opposite female end, including the additional steps of:

forming an I-shaped male tab on the male end of the barrier, the I-shaped tab having a lower extension and an upper extension, the lower extension of the I-shaped male tab forming the locking means near the bottom of the male end and the upper extension of the I-shaped male tab forming the locking means near the middle of the male end; and securing a locking bar to the top of the male end such that it is extendable outward from the male end for attachment to the upper surface of an adjacent interlocking barrier;

forming the female end with locking means near the bottom, middle, and top of the female end, including the additional steps of:

forming an I-shaped female slot having a lower extension cavity and an upper extension cavity and locating them to accept the I-shaped male tab of an adjacent interlocking barrier such that when the I-shaped male tab of the adjacent barrier is inserted into the female slot of the barrier, the barriers are securely held; and using a locking bar to secure the top of the male end of the interlocking barrier to the top of the female end of an adjacent interlocking barrier;

whereby the end of the interlocking barrier is secured to the end of another interlocking barrier at the top, the middle, and the bottom.

12. A method, as in claim 11, including the additional step of attaching the locking bar to top of the interlocking barrier with a hinge, the locking bar hingedly movable from an attached position in which it extends outward from the end of the interlocking barrier over the end of an adjacent interlocking barrier, to a storage position in which it is hingedly folded back such that it does not extend over the end of the interlocking barrier.

13. A method, as in claim 12, including the additional step of forming a storage cavity in the male end of the interlocking barrier, the storage cavity sized to accept the locking bar when the locking bar is moved to the storage position.

14. A method, as in claim 13, including the additional step of forming a locking cavity in the female end of the interlocking barrier, the locking cavity sized to accept the locking bar when the locking bar is moved to the storage position.

15. A method, as in claim 14, including the additional steps of:

attaching a retaining clamp to the top of the locking cavity;

forming an aperture in the locking bar, the aperture sized to allow the retaining clamp to project through the locking bar of an adjacent interlocking barrier when the locking bar is in the attached position; and attaching a retaining pin to the retaining clamp when the locking bar of an adjacent interlocking barrier is attached to the interlocking barrier such that the locking bar of the adjacent interlocking barrier is prevented from being detached from the interlocking barrier.

16. A method, as in claim 15, including the additional steps of:

inserting an upper locking pin through the upper extension of the male tab of the interlocking barrier and the female end of the adjacent interlocking barrier such that the upper extension is prevented from being detached from the female end of the adjacent barrier; and inserting a lower locking pin through the lower extension of the male tab of the interlocking barrier and the female end of the adjacent interlocking barrier such that the upper extension is prevented from being detached from the female end of the adjacent barrier.

17. A method, as in claim 16, including the additional step of forming a plurality of support ribs extending inward from the side wall of the interlocking barrier such that the side wall of the interlocking barrier is not flat;

whereby the support ribs prevent the side walls of the interlocking barrier from bowing under pressure.

18. A method, as in claim 12, including the additional steps of:

forming a retaining clamp in the top of the locking cavity;

forming an aperture in the locking bar, the aperture sized to allow the retaining clamp to project through the locking bar of an adjacent interlocking barrier when the locking bar is in the attached position; and attaching a retaining pin to the retaining clamp when the locking bar of an adjacent interlocking barrier is attached to the interlocking barrier such that the locking bar of the adjacent interlocking barrier is prevented from being detached from the interlocking barrier.

19. A method, as in claim 18, including the additional steps of:

inserting an upper locking pin through the upper extension of the male tab of the interlocking barrier and the female end of the adjacent interlocking barrier such that the upper extension is prevented from being detached from the female end of the adjacent barrier; and inserting a lower locking pin through the lower extension of the male tab of the interlocking barrier and the female end of the adjacent interlocking barrier such that the upper extension is prevented from being detached from the female end of the adjacent barrier.

20. A method, as in claim 19, including the additional step of forming a plurality of support ribs extending inward from the side wall of the interlocking barrier such that the side wall of the interlocking barrier is not flat;

whereby the support ribs prevent the side walls of the interlocking barrier from bowing under pressure.

21. An interlocking barrier, comprising:

a male end having locking means near the bottom of the male end and locking means near the top of the male end, the locking means at the bottom of the male end further comprising a T-shaped male tab having a widened foot segment;

a female end having locking means near the bottom of the female end and locking means near the top of the female end, the female end further comprising a female slot having a substantially vertical slot with a widened foot cavity segment and located to accept the T-shaped male tab of an adjacent barrier such that when the T-shaped male tab of the adjacent barrier is inserted into the female slot of the barrier, the barriers are securely held; and means to secure the male end of the barrier to the female end of another barrier at the top and bottom ends;

the means to secure the bottom of the male end of the adjacent barrier to the bottom of the female end of the barrier further comprises a locking pin; and the means to secure the top of the male end of the adjacent barrier to the top of the female end of the barrier further comprises a locking bar channel in the top of the barrier at the male end of the barrier and a corresponding locking bar channel in the top of the barrier at the female end of the barrier, the locking bar having a locked and an unlocked position, the locking bar, when in the locked position, extending across the top of the barrier and the adjacent barrier and snugly fit in the locking bar channel of the male end of the barrier and also snugly fit in the locking bar channel of the adjacent barrier, the locking bar and channel cooperating to prevent lateral movement of the top of the adjacent barriers in regard to one another;

whereby the locking bar prevents separation of the top of the barrier from an adjacent barrier when impacted, and the T-shaped male tab, and the locking pin act in concert to secure the barrier, which is secured to an adjacent barrier at the top, bottom, and middle.

22. An interlocking barrier, as in claim 21, further comprising:

a surface roughened to discourage graffiti by reducing graffiti legibility.

23. An interlocking barrier, as in claim 22, further comprising:

a reflective tape;

a flat surface on the barrier suitable for adhering the reflective tape.

24. An interlocking barrier, as in claim 22, wherein:

the locking pin is secured to the female slot; and the widened foot segment of the T-shaped male tab has a groove sized to snugly fit over the locking pin.

25. An interlocking barrier, as in claim 21, further comprising:

a reflective tape;

a flat surface on the barrier suitable for adhering the reflective tape.

26. An interlocking barrier, as in claim 21, wherein:

the locking pin is secured to the female slot, and the widened foot segment of the T-shaped male tab has a groove sized to snugly fit over the locking pin.

27. A method of interlocking barriers, including the steps of:

forming a male tab which extends in a generally vertical direction on the male end of the barrier;

forming a female slot in a second barrier which extends in a generally vertical direction on the female end of the barrier;

forming a locking bar channel in the top of the barrier at the male end of the barrier and a corresponding locking bar channel in the top of the barrier at the female end of the barrier;

aligning the male tab with the female slot of the second barrier such that when the male tab of the barrier is inserted into the female slot, the barriers are in substantial alignment;

securing the bottom of the male end of the barrier to the bottom of the female end of the second barrier with a locking pin;

securing the top of the male end of the barrier to the top of the female end of the second barrier with a locking bar, the locking bar having a locked and an unlocked position, the locking bar, when in the locked position, extending across the top of the barrier and the adjacent barrier and snugly fit in the locking bar channel of the male end of the barrier and also snugly fit in the locking bar channel of the adjacent barrier, the locking bar preventing lateral movement of the top of the adjacent barriers in regard to one another; and the locking bar, the male tab, and the locking pin acting in concert to secure the barriers, which are secured to an adjacent barrier at both the top and the bottom, and further to prevent them from separating when impacted.

28. A method, as in claim 27, including the additional step of:

using a roughened surface to discourage graffiti by reducing the legibility of graffiti.

29. A method, as in claim 28 including the additional steps of:

forming a flat surface on the barrier suitable for adhering to reflective tape; and adhering reflective tape to the flat surface.

30. A method, as in claim 28, including the additional steps of:

securing the locking pin to the female slot, forming a groove sized to snugly fit over the locking pin in the widened foot segment of the T-shaped male tab; and snugly fitting the groove in the widened foot segment of the T-shaped male tab over the locking pin.

* * * * *